United States Patent [19]

Stone

[11] 4,146,232

[45] Mar. 27, 1979

[54] AUTOMATIC GOLF BALL TEEING DEVICE

[76] Inventor: Arthur Stone, 3625 N. Country Club Dr., Apt. 504, N. Miami Beach, Fla. 33180

[21] Appl. No.: 855,666

[22] Filed: Nov. 29, 1977

[51] Int. Cl.[2] ..... A53B 57/00

[52] U.S. Cl. ..... 273/201; 193/17

[58] Field of Search ..... 273/33, 201, 202, 203; 221/298, 299, 301; 193/17; 209/123

[56] References Cited

U.S. PATENT DOCUMENTS

| | | | |
|---|---|---|---|
| 1,940,321 | 12/1933 | Pagett | 273/201 |
| 2,071,356 | 2/1937 | Pagett | 273/201 |
| 2,123,195 | 7/1938 | Middleton | 273/201 |
| 2,171,299 | 8/1939 | Beckett | 273/201 |
| 2,216,853 | 10/1940 | Middleton | 273/201 |
| 2,675,237 | 4/1954 | Wilcox | 273/201 |
| 3,003,770 | 10/1961 | Jones | 273/201 |
| 3,756,606 | 9/1973 | Land | 273/201 |

*Primary Examiner*—Richard C. Pinkham
*Assistant Examiner*—T. Brown
*Attorney, Agent, or Firm*—Lane, Aitken & Ziems

[57] ABSTRACT

An automatic golf ball teeing apparatus having a hollow golf ball conveying arm which is pivotal at one of its ends about an axis between a first golf ball receiving position and a second golf ball depositing position. When the arm is in the first position a ball is received at one end of the arm and when the arm is pivoted to the second position the ball will roll to the other end of the arm to be deposited on a tee. A mechanism is provided for pivoting the arm between the first and second positions. The mechanism includes a crank and an extensible rod connecting the crank to the arm and a member for rotating the crank. When the arm is pivoted to the second position it is engaged by a stop, however, the extensible rod will permit the crank to continue to turn for a predetermined distance and after the distance has been traveled by the crank the arm begins to return to the first position. During the time between the instance the arm engages the stop and the crank travels the predetermined distance the ball is permitted to roll by gravity from the ball receiving end to the ball depositing end of the arm and is depositedon a tee through an opening in the arm.

6 Claims, 6 Drawing Figures

AUTOMATIC GOLF BALL TEEING DEVICE

BACKGROUND OF THE INVENTION

This invention relates to golf driving ranges and, more particularly, to a device for automatically teeing-up a golf ball for use in connection with driving ranges.

Golf driving ranges traditionally have required large pieces of land in order to provide sufficient room for long-distance driving. With the cost of land increasing and a greater demand for such driving ranges in high population areas, there is a need to develop a driving range which can be operated indoors or on a small piece of land.

In order to maximize efficient use of time while using a driving range, it is desirable to provide an automatic golf ball teeing device which can in a matter of seconds tee up a second ball after one is driven. In addition to reducing strain on people with back problems, such a device allows more practice in a given period of time. It also would be advantageous to accommodate chip shots as well as drives so that the golfer can work on his total game and not just driving alone.

SUMMARY OF THE INVENTION

In accordance with the invention, a golf ball driving range is provided which utilizes a small area and includes a target at which the golfer can aim his shots. A hopper is located beneath the target for receiving balls bouncing off the target. The hopper contains an opening at the bottom of a sloped floor for receiving the balls, the opening being connected to a conduit which returns the balls to an automatic teeing device either by gravity or by means of a fan.

One embodiment of the automatic teeing device includes an arm at the other end of the conduit, the arm having a ball receiving pocket into which a ball can roll from the conduit. The arm is pivotally mounted and connected to a motor-driven crank through a connecting rod, such that when the motor rotates the arm will move from the ball receiving position downward to a position where the ball will roll along the arm and be deposited onto a tee. The connecting rod includes a spring member positioned so that as the crank is moving and the arm is in the ball depositing position, the arm will hesitate and remain in that position long enough to allow the ball to roll along the arm and be deposited on the tee before the arm is automatically retracted. The arm can also include a manually adjustable telescoping portion so that if the golfer wants to practice chip shots instead of tee shots, the arm can be lengthened to deposit the ball on the ground or other surface suitable for chip shots.

The driving range can include a switch located in a number of positions for automatically activating the teeing device such as, for example, at the opening in the hopper or at some point along the conduit. Further, a manually operated switch can be located near the tee so that a ball can be teed up by touching the switch with a club or foot.

A novel switch can be provided which will automatically be activated when the ball is hit off the tee. The switch includes a rotatable bar connected to the tee and located beneath the driving surface such that when the ball is driven the force of the club hitting the ball and/or tee will move the tee forward and cause the bar to rotate. This, in turn, causes a member connected at one end of the bar to rotate and contact one end of an L-shaped member pivotally mounted at its corner. The other end of the L-shaped member will engage a plunger connected to a switch and activate the device. The rotatable bar includes a counterweight for automatically returning the tee to its upright position after the plunger has been engaged by the L-shaped member.

A second embodiment of an automatic teeing device also utilizes a rod and crank mechanism, but instead of having an arm located above the ground which is rotatable between ball receiving and depositing positions, a piston is provided which moves up and down in an opening or recess in the ground. When the piston is at its lower-most position a ball can roll from the conduit onto the tee connected at the top of the piston. The piston can move upward and raise the ball above the ground into the driving position. The stroke of the piston can be adjusted to accommodate chip shots as well as drives. The piston can include an outer sleeve movably independent of the piston to prevent additional balls from moving into the path of the piston as it moves upward. The piston has a spring inside to allow the tee to retract into the piston should someone step on the tee when it projects above the ground surface.

BRIEF DESCRIPTION OF THE DRAWINGS

For a better understanding of the invention, reference may be had to the following description of several preferred embodiments of the invention taken in conjunction with the accompanying drawings in which.

FIG. **4*a* is a front plan view of an outer sleeve for the piston shown in FIG. 4.

DETAILED DESCRIPTION OF SEVERAL PREFERRED EMBODIMENTS

Figure 1:
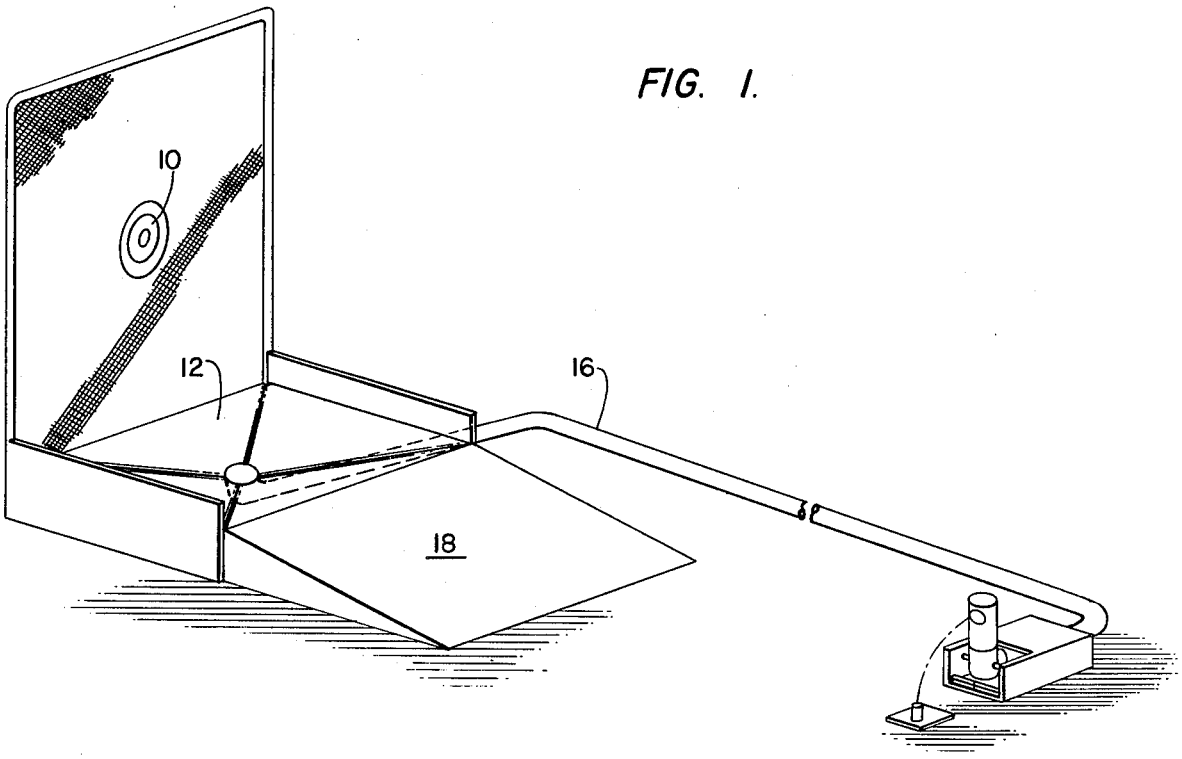
FIG. 1 is a perspective view of a driving range in which an automatic teeing device can be used.

A driving range of the type in which the inventive automatic teeing devices can be used is shown generally in FIG. 1. The driving range includes a target 10 which can be formed of or mounted on a suitable resilient cushioned-type material to prevent the golf ball from rebounding back toward the golfer. A hopper 12 is located below the target 10 and slopes downwardly away from the target 10 toward an opening 14 which leads to a conduit 16. A ramp 18 slopes upwardly from the ground to the front portion of the hopper so that balls which are hit short of the hopper will bounce or roll into the hopper 12. Alternatively, the opening 14 can be located directly beneath the target or in the front of the hopper 12.

Any type of suitable netting or mesh material can be used to surround the driving range to prevent golf balls hit inaccurately from leaving the driving range. The conduit 16 is used to return the balls back to the automatic teeing device either by gravity or by means of a blower or fan.

Figure 2:
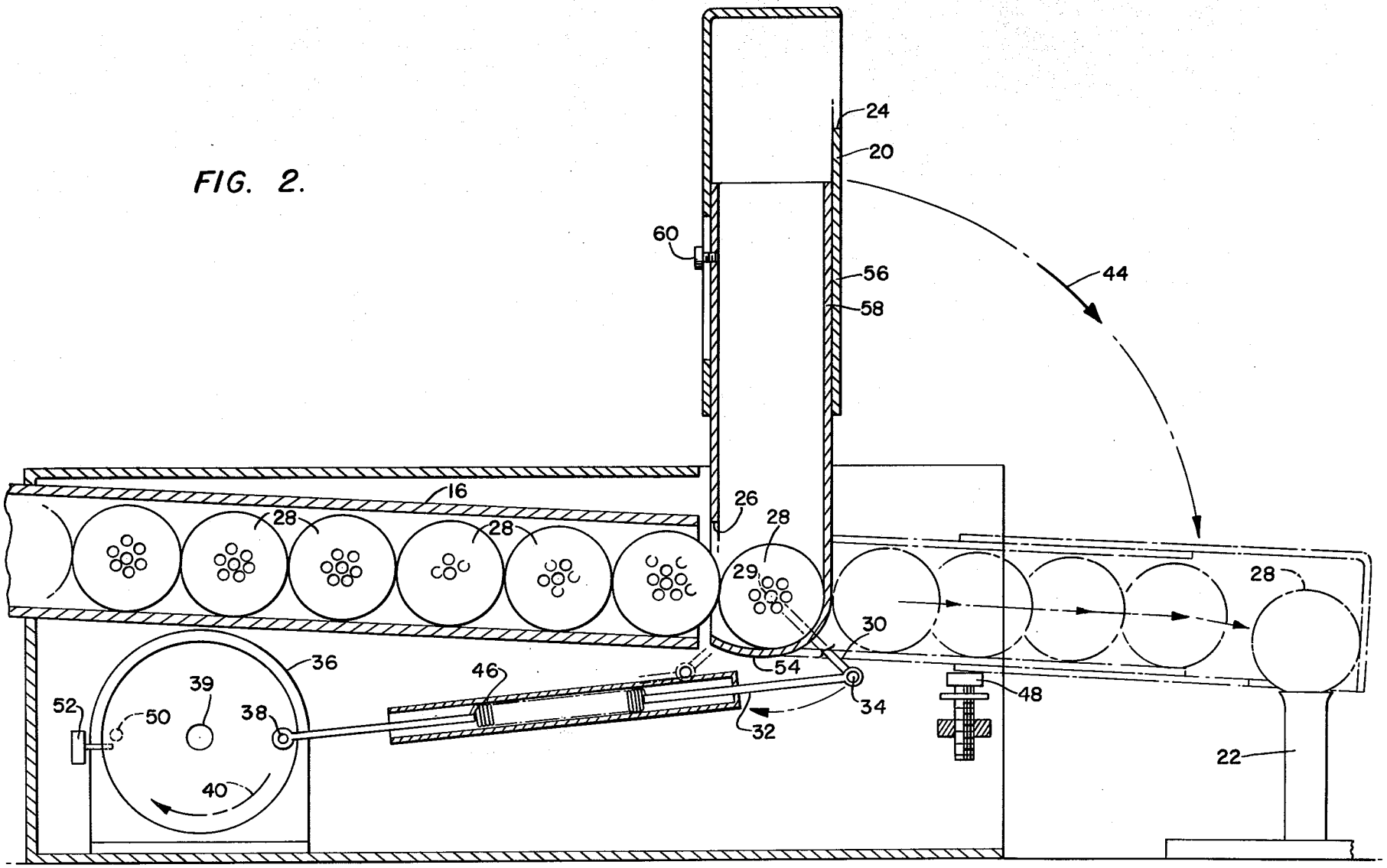
FIG. 2 is a side plan view of a movable arm type of automatic teeing device.

One embodiment of the automatic teeing device is shown in FIG. 2, which includes a movable arm 20 for depositing golf balls one at a time on a tee 22. In this embodiment, the conduit 16 and components of the automatic teeing device are all located above the surface from which the ball is driven.

The movable arm 20 can be formed of any suitable type of rigid material such as metal or plastic and includes an opening 24 located at its outer end through which a golf ball will roll onto the tee 22. The other end of the conduit 20 includes an opening 26 through which a golf ball is received. As can be seen from FIG. 2, a plurality of golf balls 28 are located in the conduit 16. When the arm 20 is in the upright position shown in FIG. 2, the forward-most ball will roll into the arm 20 through the opening 26.

The arm 20 is pivotally mounted by any suitable means at a pivot point 29. A rod 30 is rigidly connected to the arm 20 at the pivot point 29 for moving the arm 20 between the position shown by the solid lines in FIG. 2 and the position shown by the dotted lines. One end of a connecting rod 32 is pivotally connected at pivot point 34 to the rod 30, the other end being connected to a crank 36 at pivot point 38. The crank 36 is connected to a shaft 39 which is rotated by means of any suitable type of motion such as, for example, a 7 RPM, 115 volt AC, magnetic gear brake motor. As the motor causes the crank 36 to rotate in the direction of the arrow indicated by reference numeral 40, the connecting rod 32 will pull the rod 30 and cause the arm 20 to move downward in the direction of the arrow designated by reference numeral 44 to the position shown by the dotted lines.

When the arm 20 reaches the position shown by the dotted lines, the ball will roll down the arm 20, as shown by the dotted lines, and be deposited on the tee 22. It has been found, however, that the arm 20 must be allowed to hesitate a short time in the lowered position so that the ball will have enough time to roll along the length of the arm 20. This can be done by providing a spring 46 in the connecting rod 32 and a stop 48 in the path of the arm 20. The stop 48 is set to engage the arm 20 at the appropriate height for depositing the ball on the tee 22 and before the pivot point 38 reaches a position 180° removed from that shown in FIG. 1. When the arm 20 engages the stop 48, the crank 36 will continue to rotate and the spring 46 will expand causing the arm 20 to hesitate and allow the ball 28 enough time to roll onto the tee 22. As the crank 36 continues to rotate past the 180° point, the spring 46 will compress a sufficient amount to push the rod 30 for raising the arm 20 back to the position shown in FIG. 2.

After the completion of one cycle as discussed, a stop 50 located on the crank 36 will trip a limit switch 52 and cause the motor to shut off automatically. It can also be seen that as the arm 20 is moving downwardly to the position where the ball 28 is deposited onto the tee 22, the remaining balls will remain in the position shown in the conduit 16 because the forward-most ball will engage a back wall 54 of the arm 20 and be prevented from moving until the arm 20 is once again in the raised position at which time the forward-most ball 28 will roll into the arm 20 and the other balls will advance one position.

In order to allow a golfer to practice chip shots as well as tee shots, the arm 22 is provided with a telescopic section formed by an outer sleeve 56 and an inner sleeve 58 so that when a set screw 60 is loosened the outer sleeve 56 can be pulled outwardly to lengthen the arm 20 and allow the ball to be deposited beyond the tee 22.

The teeing mechanism can automatically be activated by means of a switch located at various places in the system. For example, a switch could be located in the opening 14 or at any point along the conduit 16 to be activated by a golf ball. An auxiliary manually-operated switch can be located near the tee 22 to allow the golfer merely to touch the switch with his golf club or foot when another ball is desired. These switches could be connected to a coin-operated mechanism so that a golfer could be entitled to receive a predetermined number of balls after depositing one or more coins.

Figure 3:
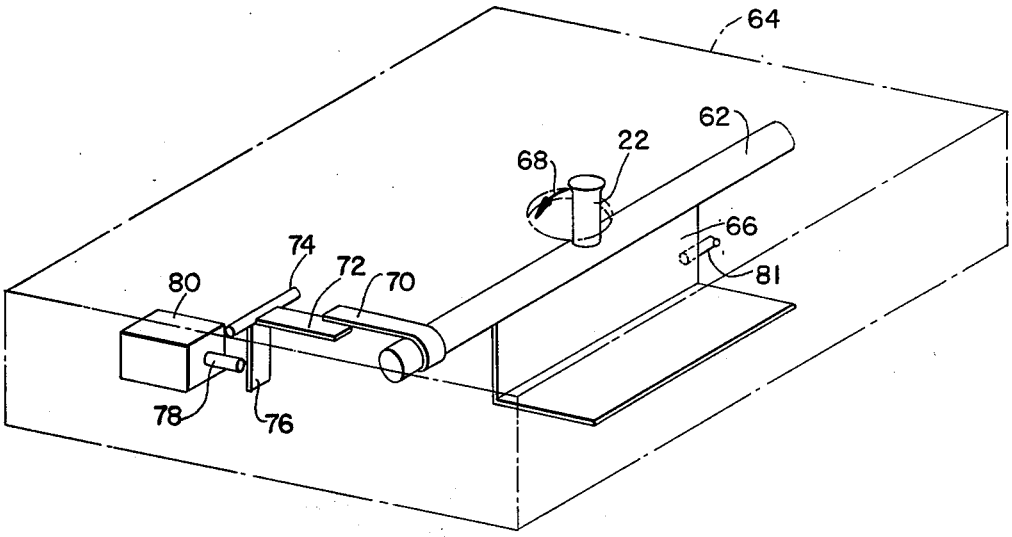
FIG. 3 is a perspective view of a switching device which operates automatically as a ball is driven from the tee of the device shown in FIG. 2.

A unique type of switching mechanism, as shown in FIG. 3, can also be provided which automatically tees up another ball as soon as the ball on the tee is driven. As shown in FIG. 3, the tee 22 is rigidly mounted on a rod 62 which is rotatably mounted inside a box designated by reference numeral 64 and shown by the dotted lines. A counterweight 66 is connected along the lower edge of the rod 62 to maintain the tee 22 in the upright position shown in FIG. 3.

When the ball is hit off of the tee 22, the force of the club hitting either the tee or the ball will cause the rod 62 to rotate in the direction of an arrow designated by reference numeral 68 which in turn will cause an arm 70 which is connected to the rod 62 to rotate and engage an L-shaped member 72. The L-shaped member 72 is pivoted about a pin 74 so that the edge of the bottom portion of the "L" will be caused to move and depress a plunger 78 of a limit switch 80 which will close the circuit of the motor and move the arm 20 as discussed above. As soon as the plunger 78 is engaged by the L-shaped member 76, the tee 22 will automatically rotate back to its initial position by means of the counterweight 66 so that the next ball can be deposited onto the tee 22. A stop 81 can be located on the path of the counterweight 66 to prevent the tee 22 from rotating past its normally upright position.

Figure 4:
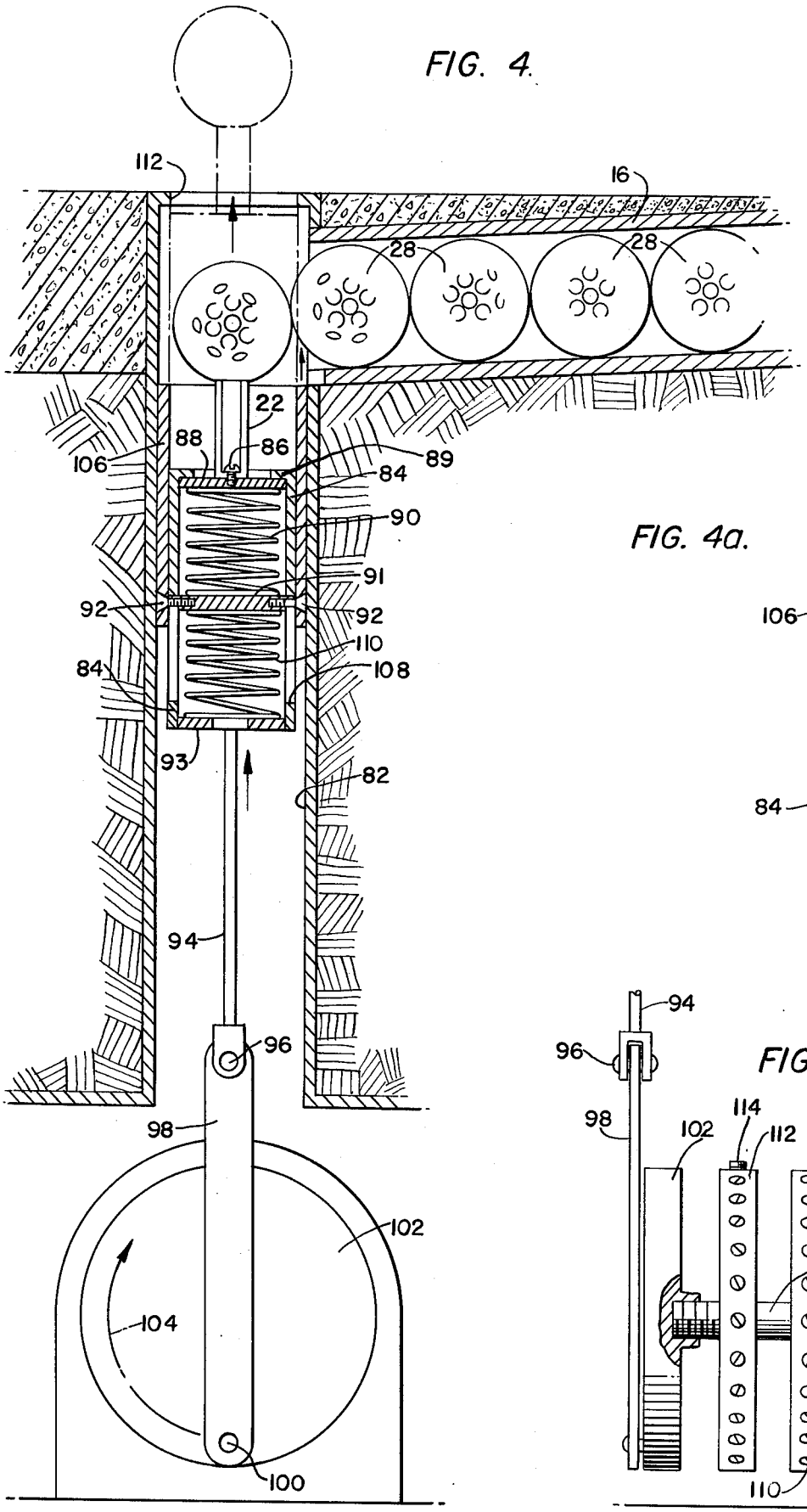
FIG. 4 is a side plan view of an automatic teeing device which includes a piston and is recessed beneath the driving surface.

In another embodiment of the invention, as shown in FIG. 4, the automatic teeing device can be totally contained beneath the surface of the ground. As shown, the conduit 16 opens into a vertical cylindrical chamber 82 in which a piston 84 is movable up and down. The tee 22 is connected to the upper end of the piston 84 by means of a screw 86. The upper end of the piston 84 is formed of a plug 88 which is held in place by menas of a flange 89 located around the upper perimeter of the piston 84 and a spring 90 located inside of the piston. The lower end of the spring 90 bears against a second plug 91 located inside the piston 84, which is held in place by screws 92. The other structure inside the piston 84 will be described below. This spring and plug mechanism will allow the tee 22 to be depressed into the ground when the tee is in its uppermost position projecting out of the ground, should someone step on the tee, thereby preventing the tee and other elements of the device for becoming damaged.

The bottom portion of the piston is formed by a plate 93 to which a rod 94 is connected. The rod 94 is pivotally connected at a pivot point 96 to a connecting rod 98 which in turn is connected at the pivot point 100 to a crank 102 which is mounted on a shaft 103 of a motor such as that described above. The motor will cause the crank 102 to rotate in the direction of an arrow designated by reference numeral 102. When this occurs, the connecting rod 98 will move upwardly which will cause the piston 84 to move upwardly and raise the ball which is on the tee 22 above the surface of the ground.

Figure 4A:
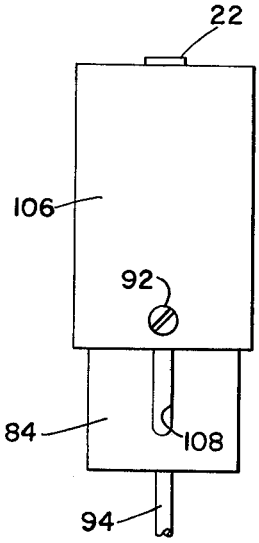
FIG. 4*b* is a front plan view of a crank and indexing mechanism for the teeing device shown in FIG. 4**.

In order to prevent the remaining balls 28 in the conduit 16 from interfering with the upward movement of the piston 84, a sleeve 106 is slidably mounted around a portion of the outer surface of the piston 84 and projects above the piston to just below the top of the tee 22. As shown in FIGS. 4 and 4*a*, the piston 84 includes two slots 108 in which the screws 92 can slide for moving the plug 91. A second spring 110 is located inside the piston 84 below the plug 91. A flange 112 is located around the upper periphery of the chamber 82, which projects into the path of the sleeve 106. After the ball 28 is on the tee 22 the piston 84 will move upwardly and carry the sleeve 106 into the path of the balls 28 in the conduit 16. When the sleeve 106 engages the flange 112, the sleeve 22 will stop moving, but the piston 84 will continue to move with the screws 92 sliding along the slots 108. This will cause the plug 91 to move downward relative to the piston 84 and compress the spring 110. The spring 110 will return the plug 91 back to its initial position when the piston 84 again moves downward.

Once the golf ball is driven from the tee 22, the motor can be activated in any suitable way, causing the crank 102 to move in the direction of the arrow 104 and pull the piston 84 downward. When the piston 84 and sleeve 106 once again reach the position shown in FIG. 4, the next forward-most ball will roll out of the conduit 16 and onto the tee 22 and the remaining balls will each move forward one position.

Figure 4B:
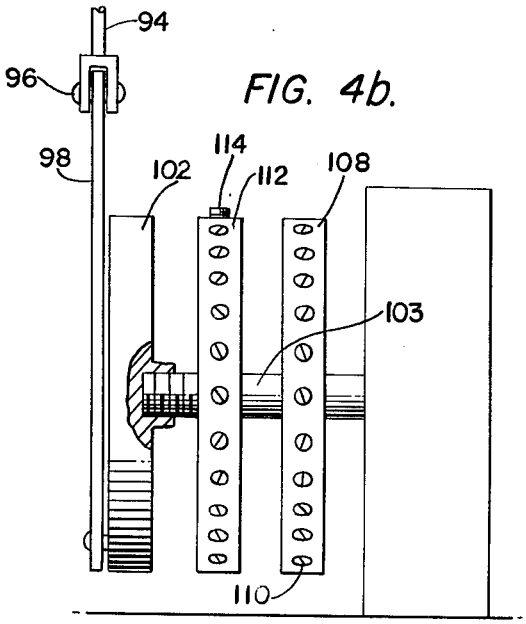

The height of the ball above the ground can be regulated by means of indexing stops as shown in FIG. 4*b*, where a cam plate 112 is shown with a series of set screws 114 which can be screwed into or out of the cam plate 112 to trip a limit switch for stopping the motor. A second cam plate 116 with a series of indexing screws 118 is also provided for stopping the mechanism at an appropriate lowered position.

Thus, there is provided in accordance with the invention several alternative automatic teeing devices which quickly and easily tee-up golf balls with no bending required by the player. The arm-type embodiment has advantageous features such as the telescoping arm so that the teeing device can be used both for driving and chip shots and a connecting rod with expansion means therein to allow the arm to remain in a lowered position long enough for the ball to roll onto the tee. The recessed embodiment includes a spring-loaded piston so that should a person step on the tee it will be depressed so that the mechanism will not be damaged or the tee broken. Further, the sleeve mechanism which cooperates with the piston provides an effective way to prevent other balls in the conduit from interfering with the piston.

It should be understood that those with ordinary skill in the art will be able to make improvements and modifications to the embodiments described above and that all such improvements and modifications are contemplated as falling within the scope of the appended claims.

I claim:

1. An automatic golf ball teeing apparatus, comprising: an arm, means for moving said arm about an axis between a first golf ball receiving position and a second golf ball depositing position, one end of the arm including a golf ball receiving portion for receiving a golf ball from a golf ball supply means when the arm is in the first position, and a golf ball depositing portion for depositing a golf ball when said arm is in said second position, said arm further including a rolling surface on which a golf ball can roll which extends from the receiving portion at one end thereof, to said golf ball depositing portion at the other end thereof, said gold ball depositing portion includes means for stopping a ball and means for allowing the ball to drop by gravity from said surface after the ball is engaged by said stopping means, said means for moving includes rotatable crank means to rotate said crank and a connecting rod pivotally mounted at one end to said crank and at its other end to said arm, means for stopping said arm at said second position, said connecting rod includes extension means, said crank and rod being located and dimensioned so that said arm will engage said stop means when said crank has rotated a first predetermined distance and said extension means will allow said crank to continue to rotate a second predetermined distance while said arm remains in said second position so that said ball can roll along said surface, said crank continuing to rotate and return said arm to its first position after rotating through said second predetermined distance.

2. The apparatus in claim 1, wherein the arm is a tube closed at the ends with openings located on opposite sides and at opposite ends.

3. The apparatus in claim 1, wherein the arm includes telescoping means for changing the length thereof.

4. The apparatus in claim 3, wherein the telescoping means includes two sleeves, one slidable relative to the other, and means for locking the sleeves relative to each other.

5. The apparatus in claim 1, wherein said rod includes two sections and said extension means is a spring connecting said rod sections.

6. The apparatus in claim 5, wherein when the crank rotates less than 180° from when the arm is in the first position the arm will engage the stop means and cause the spring to expand.

* * * * *

UNITED STATES PATENT AND TRADEMARK OFFICE

CERTIFICATE OF CORRECTION

PATENT NO. : 4,146,232

DATED : March 27, 1979

INVENTOR(S) : Arthur Stone

It is certified that error appears in the above-identified patent and that said Letters Patent are hereby corrected as shown below:

In the Abstract, next to the last line, "depositedon" should read -- deposited on --;

Column 4, line 47, "menas" should read -- means --;

Column 4, line 58, "for" should read -- from --;

Column 6, line 16, the comma [,] should be deleted;

Column 6, line 18, "rolling" should be deleted;

Column 6, line 25, -- a -- should be inserted before "rotatable";

Column 6, line 26, after "crank" (first occurrence) a comma [,] should be inserted.

Signed and Sealed this

*Fourth* Day of *September 1979*

[SEAL]

*Attest:*

*Attesting Officer*

LUTRELLE F. PARKER

*Acting Commissioner of Patents and Trademarks*